US007061436B2

(12) United States Patent
Izumi

(10) Patent No.: US 7,061,436 B2
(45) Date of Patent: Jun. 13, 2006

(54) ANTENNA DEVICE

(75) Inventor: Hiroyuki Izumi, Nagoya (JP)

(73) Assignee: Buffalo Inc., Nagoya (JP)

( * ) Notice: Subject to any disclaimer, the term of this patent is extended or adjusted under 35 U.S.C. 154(b) by 32 days.

(21) Appl. No.: 10/883,185

(22) Filed: Jun. 30, 2004

(65) Prior Publication Data

US 2005/0024276 A1 Feb. 3, 2005

(30) Foreign Application Priority Data

Jul. 1, 2003 (JP) ..... 2003-189219

(51) Int. Cl.
*H01Q 1/24* (2006.01)
*H01Q 1/08* (2006.01)

(52) U.S. Cl. ..... 343/702; 343/880

(58) Field of Classification Search ..... 343/702, 343/700 MS, 818, 834, 895, 880, 882
See application file for complete search history.

(56) References Cited

U.S. PATENT DOCUMENTS

| | | | | |
|---|---|---|---|---|
| 5,966,099 | A | 10/1999 | Xue | 343/702 |
| 6,208,300 | B1 * | 3/2001 | Johnson | 343/702 |
| 6,278,413 | B1 * | 8/2001 | Hugh et al. | 343/818 |
| 6,806,841 | B1 * | 10/2004 | Nilsson et al. | 343/773 |
| 2004/0150568 | A1 * | 8/2004 | Chiang et al. | 343/702 |

FOREIGN PATENT DOCUMENTS

| | | |
|---|---|---|
| JP | 63-16707 | 2/1988 |
| JP | 1-81016 | 5/1989 |
| JP | 9-18227 | 1/1997 |
| JP | 2002-64328 | 2/2002 |
| JP | 2002-300069 | 10/2002 |

OTHER PUBLICATIONS

Japanese Office Action dated Aug. 2, 2005 from corresponding Japanese Application No. 2003-189219.

* cited by examiner

*Primary Examiner*—Tan Ho
*Assistant Examiner*—Minh Dieu A
(74) *Attorney, Agent, or Firm*—Beyer Weaver & Thomas, LLP

(57) ABSTRACT

In an antenna device of the invention used for a wireless LAN, a first substrate with a conductive pattern formed thereon to function as a radiator and a second substrate with conductive patterns formed thereon to function as a wave director and a reflector are held respectively in an inner casing and in an outer casing of the antenna device in a slidable manner. The antenna device is attached to a top face of an access point by means of a three-dimensional joint. The user loosens a screw attached to the outer casing and slides the inner casing relative to the outer casing, so as to change the positional relation of the inner casing to the outer casing. The simple change of the positional relation readily switches over the directional characteristic of the antenna device between a first position where the wave director, the radiator, and the reflector are arranged in parallel across preset distances and the antenna device functions as a Yagi-Uda antenna having high directional characteristic with regard to 2.4 GHz radio frequency signals and a second position where neither the wave director nor the reflector practically works and the antenna device functions as a non-directional antenna.

18 Claims, 9 Drawing Sheets

ANTENNA DEVICE

BACKGROUND OF THE INVENTION

1. Field of the Invention

The present invention relates to an antenna device, and more specifically to an antenna device used for extremely high frequency (EHF) wireless LANs.

2. Description of the Related Art

Non-directional antenna devices have generally been used for wireless LANs. The non-directional antenna device allows the users at any positions in a predetermined coverage to access a wireless LAN. The antenna device is located on the center or at a specific corner in the area of the predetermined coverage of the wireless LAN. The users in the predetermined coverage can accordingly access the wireless LAN without giving special attention to the position of the antenna device.

In the application of a wireless LAN between multiple different buildings, for example, two buildings, access points for the wireless LAN are respectively set in the two buildings. Directional antenna devices having high directional characteristic are located to face each other in the two different buildings and are linked to respective access points for the connection of the wireless LAN. This layout extends the coverage of the respective antenna devices, while restricting accesses from unauthorized devices.

The directional antenna device and the non-directional antenna device for the wireless LANs are completely different and separate systems, and either the directional antenna device or the non-directional antenna device is selected according to the applications. Some change of the settings at an access point may thus require replacement of the whole antenna device.

The directional antenna and the non-directional antenna have substantially opposite directional characteristics and dot not satisfy a demand for a certain level of directional characteristic, which is lower than the directional characteristic of the directional antenna. Such requirements are often found when the access point is located at the corner of a room or a building. Application of a non-directional antenna to the demand may cause an insufficient coverage and allow illegal accesses from outside the room or the building.

SUMMARY OF THE INVENTION

The object of the invention is thus to provide an antenna device that is capable of changing its directional characteristic.

In order to attain at least part of the above and the other related objects, the present invention is directed to an antenna device used for an extremely high frequency wireless LAN. The antenna device has a wave director of a preset length, a reflector, and a radiator that are arranged to have a changeable positional relation; and a switchover mechanism that moves at least one of the wave director, the reflector, and the radiator to switch over the positional relation between a first position where the wave director, the reflector, and the radiator are arranged in parallel with one another across preset intervals and have identical centers and a second position that is different from the first position. The antenna device functions as a directional antenna at the first position, while functioning as a non-directional antenna at the second position.

In the antenna device of the invention, the positional relation of the wave director, the reflector, and the radiator is changeable between the first position where the antenna device functions as the directional antenna and the second position where the antenna device functions as the non-directional antenna. Namely one antenna device serves as both the directional antenna and the non-directional antenna. Adequate selection of an intermediate position between the first position and the second position enables the antenna device to work as an antenna having a certain degree of directional characteristic that is lower than the degree of directional characteristic as the directional antenna.

In one preferable structure of the antenna device, the wave director and the reflector are located in parallel across a predetermined distance on a first member, while the radiator is located on a second member, which is different from the first member. The first member and the second member are movable to attain the first position and the second position. In the antenna device of this structure, the antenna device is readily switched over between the application as the non-directional antenna and the application as the directional antenna by only the simple relative motion of the two members.

It is preferable that the first member and the second member are movable between the first position and the second position by a sliding motion or a rotational motion. In another preferable structure of the antenna device, the wave director, the reflector, and the radiator are located respectively on a first member, a second member, and a third member. The first member, the second member, and the third member are movable between the first position and the second position by a sliding motion or a rotational motion.

In one preferable embodiment of the antenna device, the wave director and the reflector are arranged in parallel with an axial direction of the radiator to attain the first position, while at least one of the wave director and the reflector is moved to a location crossing the axial direction of the radiator to attain the second position. In the antenna device, the functions of the wave director and the reflector located at the position crossing the radiator are restricted according to their angles with the radiator. The wave director and the reflector have practically no functions when the wave director and the reflector are located at right angles with the radiator.

The wave director may be constructed by only one conductor or may have multiple conductors arranged in parallel. In the Yagi-Uda antenna for extremely high frequency, the optimum pitch and the optimum layout of the conductors in the wave director are readily computable.

In one preferable application of the antenna device of the invention, the switchover mechanism moves at least one of the wave director, the reflector, and the radiator to attain a third position, which is an intermediate position between the first position and the second position. The antenna device has an intermediate application between the application as the directional antenna and the application as the non-directional antenna at the third position. The third position is specified experimentally.

The antenna device may be connected to an access point device for controlling the wireless LAN via a cable or may be attached directly to the access point device, for example, by means of a hardware element like a three-dimensionally movable joint. Attachment of the antenna device to the access point device by means of the three-dimensionally movable joint desirably sets the user's desired area to the coverage of the antenna device.

The antenna device is electrically connected with the access point device. A signal line may pass through inside of the joint to establish electrical connection with the access point device. This structure does not expose the signal line and thus facilitates handling of the signal line.

In another preferable embodiment, the antenna device has a sucker that is fixable to a housing of the access point device. Even when the whole length of the antenna device is varied between the first position and the second position, the antenna device is securely fastened to the housing of the access point device by means of the sucker.

These and other objects, features, aspects, and advantages of the present invention will become more apparent from the following detailed description of the preferred embodiments with the accompanying drawings.

DESCRIPTION OF THE PREFERRED EMBODIMENTS

Some modes of carrying out the invention are discussed below as preferred embodiments.

(1) Structure of Antenna Device

Figure 1:
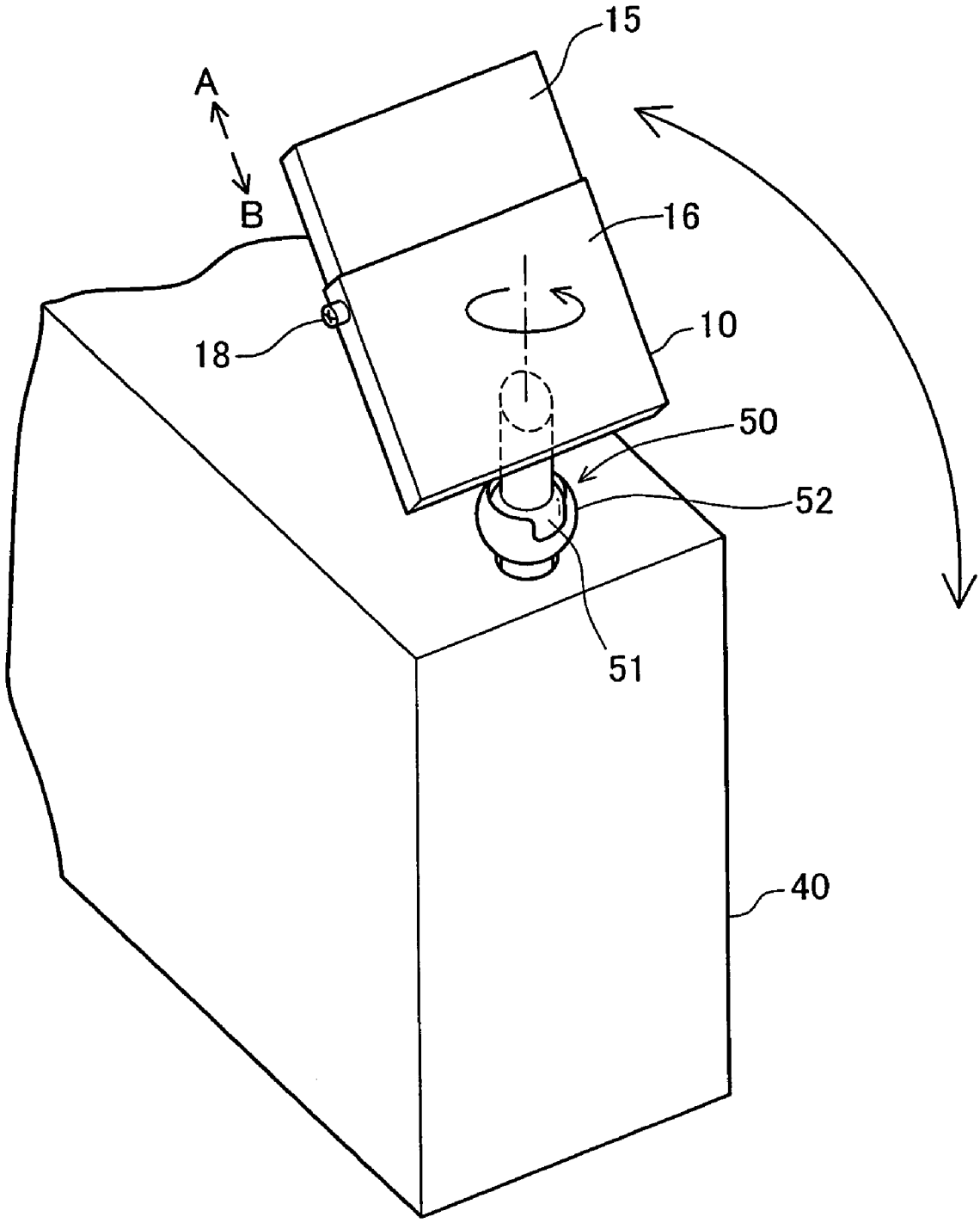
FIG. 1 is a perspective view schematically illustrating the appearance of an antenna device in a first embodiment of the invention.

The exterior structure of an antenna device 10 in a first embodiment of the invention is discussed below with reference to FIG. 1. FIG. 1 is a perspective view schematically illustrating the appearance of the antenna device 10 in the first embodiment. The antenna device 10 is linked to a top face of an access point 40 via a three-dimensional joint 50. The access point 40 gives a permission to each client computer to access a wide-area network like the Internet by means of a wireless LAN. The three-dimensional joint 50 has an inner member 51 having a pole end and an outer member 52 surrounding the inner member 51. The outer member 52 holds the inner member 51 with a certain pressure, so that the inner member 51 is kept at a desired inclined angle. The inner member 51 is axially rotatable relative to the outer member 52. The position and the angle of the antenna device 10, which is attached to the three-dimensional joint 50 at a preset angle, are thus practically freely selectable, except the position and the angle interfering with the access point 40. The position and the angle of the antenna device 10 are of extreme importance especially for the application as a directional antenna having a high directional characteristic, as discussed later.

The antenna device 10 includes an inner casing 15 that holds a first substrate 11 therein and an outer casing 16 that holds a second substrate 12 therein. The inner casing 15 is slidable in the directions of arrows A and B relative to the outer casing 16. The outer casing 16 has a screw 18 on its side face to fix the inner casing 15 at a selected position. The user loosens the screw 18, moves the inner casing 15 back and forth to select an adequate position relative to the outer casing 16, and tightens the screw 18 to fix the inner casing 15 at the selected position. Markings MK are printed on one face of the inner casing 15 to show a functioning position as a directional antenna, a functioning position as a non-directional antenna, and a middle position therebetween relative to the position of the outer casing 16. The positional change of the substrates 11 and 12 held inside the respective casings 15 and 16 and the related variation in directional characteristic according to the positional relation of the inner casing 15 to the outer casing 16 will be discussed later in detail.

Figure 2:
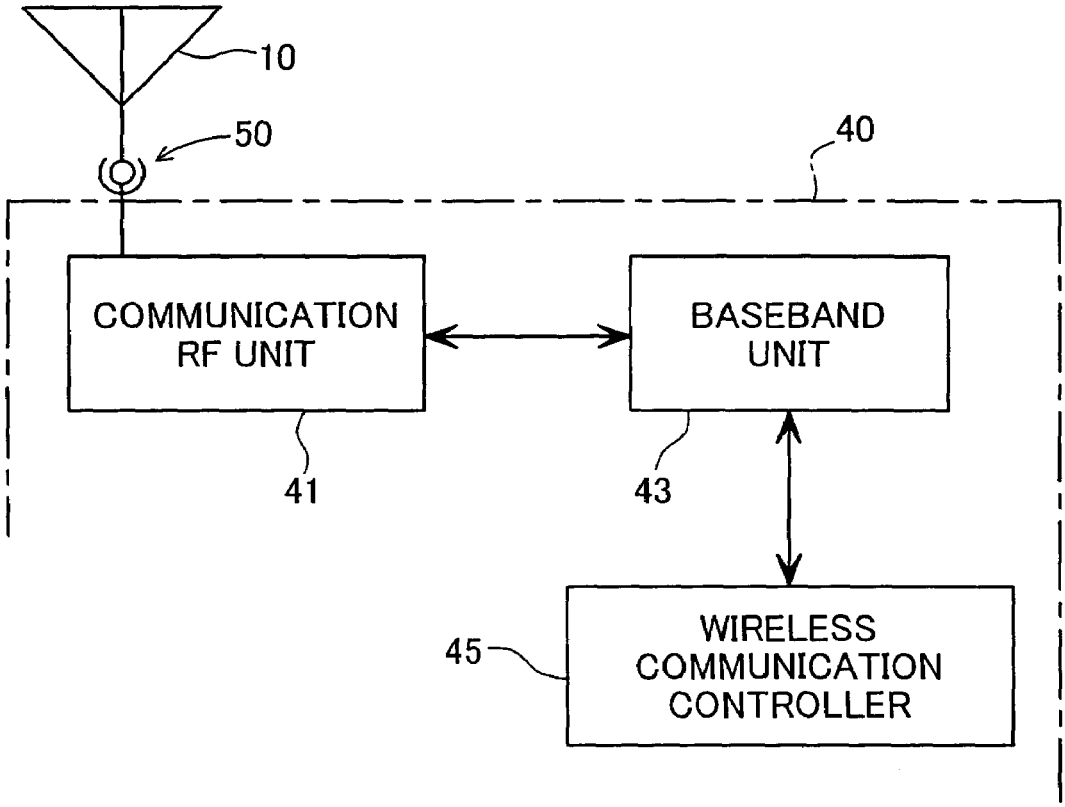
FIG. 2 is a block diagram showing electrical connection of the antenna device of the first embodiment with an access point.

The antenna device 10 is electrically connected to the access point 40 as shown in the block diagram of FIG. 2. The antenna device 10 is linked to a communication radio frequency (RF) unit 41 included in the access point 40. A signal line from the communication RF unit 41 passes through the inside of the three-dimensional joint 50. The signal line may pass through an inner space of the three-dimensional joint 50, or signals may be transmitted via a slip ring structure provided in the three-dimensional joint 50. The signal line from the antenna device 10 may be connected to the communication RF unit 41 in the access point 40 via a connector, instead of via the three-dimensional joint 50.

The communication RF unit 41 is linked to a baseband unit 43, which is electrically connected with a wireless communication controller 45. Radio frequency (RF) signals of 2.4 GHz RF or EHF (extremely high frequency) are transmitted between the antenna device 10 and the communication RF unit 41. Intermediate frequency (IF) signals are transmitted between the communication RF unit 41 and the baseband unit 43. Digital signals are transmitted between the baseband unit 43 and the wireless communication controller 45.

The communication RF 41 unit is constructed by a one-chip microcomputer including diverse mixers, amplifiers, and filters for transmitting and receiving functions. The communication RF unit 41 takes charge of conversion between RF signals and IF signals (hereafter referred to as RF/IF conversion). The baseband unit 43 is also constructed by a one-chip microcomputer including diverse mixers, amplifiers, and filters for transmitting and receiving functions. The baseband unit 43 takes charge of conversion between IF signals and baseband signals and A/D conversion between baseband signals and digital signals. The wireless communication controller 45 is called a media access controller (MAC) and is constructed by a one-chip microcomputer including a CPU, a ROM, a RAM, and various communication interfaces. The wireless communication controller 45 takes charge of diverse controls relating to wireless LAN communication.

Figure 3A:
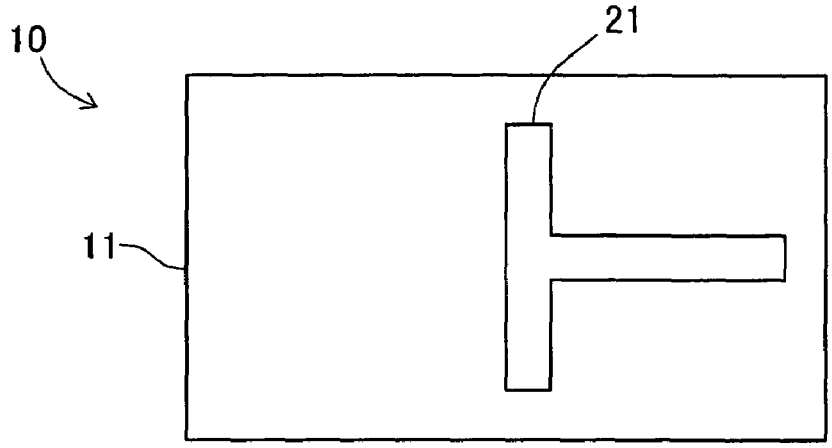
FIG. 3(A), 3(*b*), and 3(C) show the structure of a first substrate and a second substrate held inside the antenna device of the first embodiment.

The discussion now regards the internal structure of the antenna device 10. As shown in FIG. 3(A), the two substrates 11 and 12 are essentially held in the antenna device 10. In the structure of this embodiment, both the substrates 11 and 12 are glass epoxy substrates, although other resin substrates may also be adopted. One of the two substrates, the first substrate 11 shown in FIG. 3(A) has a T-shaped conductive pattern 21, which works as a radiator. The T-shaped conductive pattern 21 is made of copper foil and has one end DE linked to the communication RF unit 41 for power supply. One arrangement of the antenna device 10 functions as an EHF antenna called Yagi-Uda antenna. The conductive pattern 21 works as the radiator in the structure of the Yagi-Uda antenna.

Figure 3B:
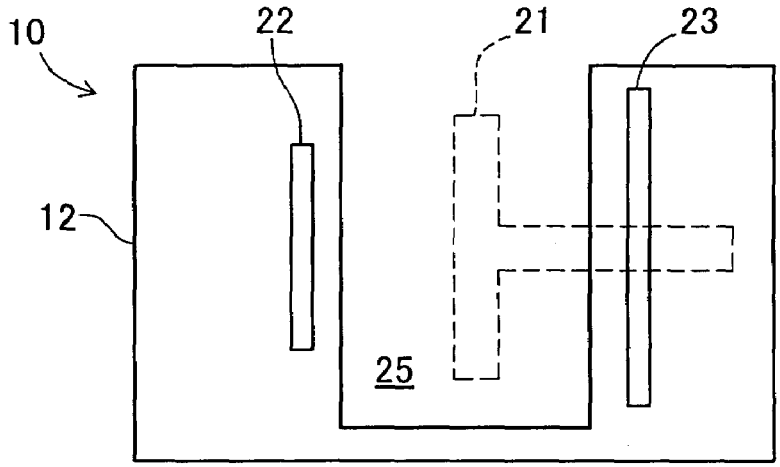
Figure 3C:
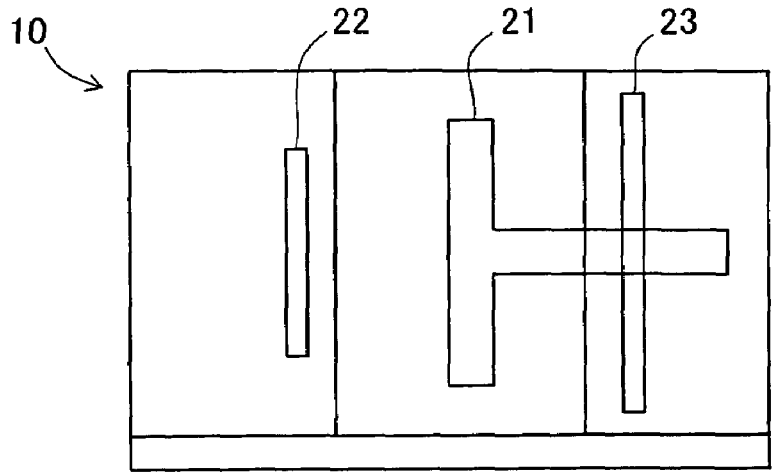

The other of the two substrates, the second substrate 12 shown in FIG. 3(B) has a concave 25 in a center area. The second substrate 12 has two conductive patterns 22 and 23 made of copper foil. The dimensions of the conductive patterns 22 and 23 will be described later. The two conductive patterns 22 and 23 are arranged in parallel across the concave 25 and have identical centers across the width. When the first substrate 11 and the second substrate 12 are combined with each other as shown in FIG. 3(C), the conductive pattern 21 on the first substrate 11 and the conductive patterns 22 and 23 on the second substrate 12 are arranged in parallel with the identical centers across the width. In the state of FIG. 3(C), the conductive pattern 22 and the conductive pattern 23 respectively work as a wave director and a reflector, while the conductive pattern 21 functions as the radiator. The conductive patterns 21, 22, and 23 accordingly function as the Yagi-Uda antenna as a whole.

Figure 4:
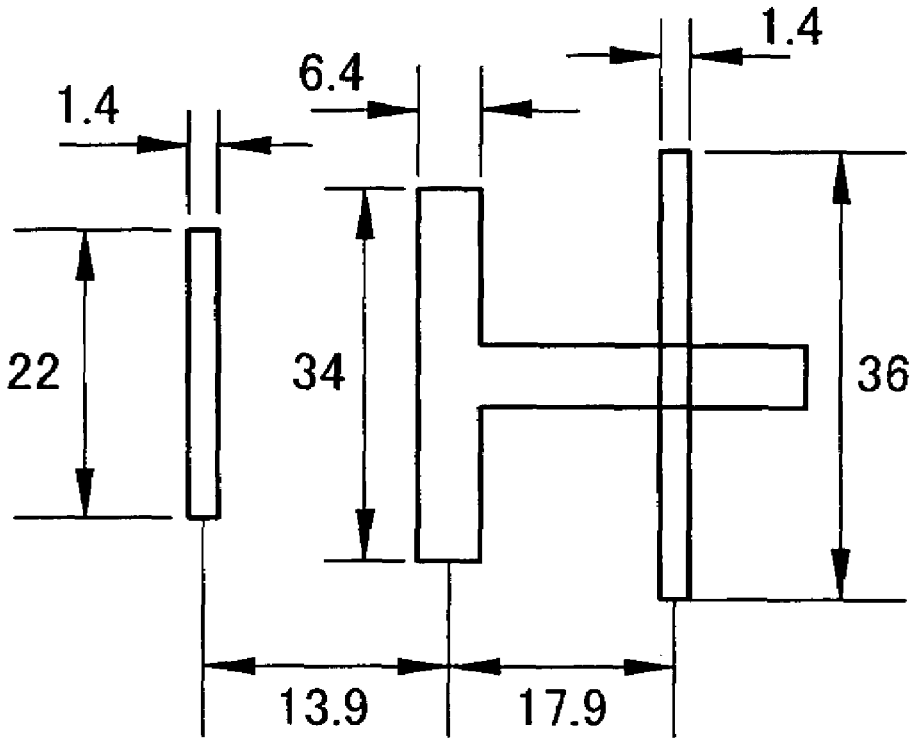
FIG. 4 shows an arrangement of conductive patterns when the antenna device of the first embodiment functions as a directional antenna.
Figure 5A:
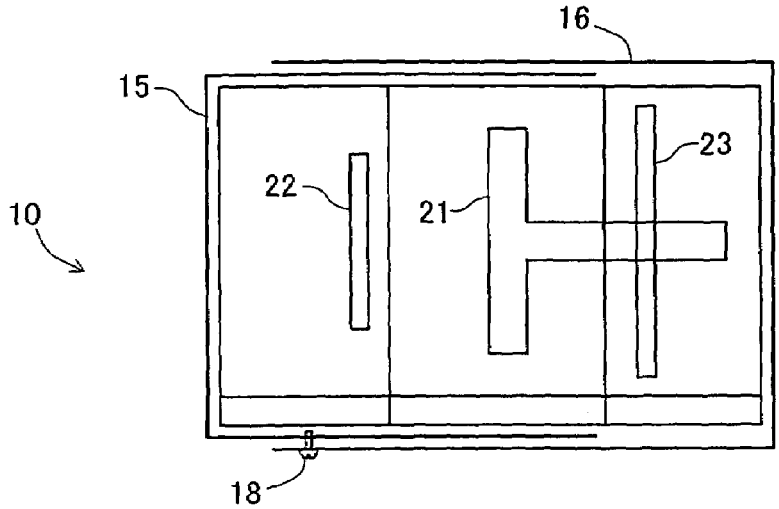
FIG. 5(A), 5(B), and 5(C) show the positional relation of an inner casing to an outer casing of the antenna device with a change in arrangement of conductive patterns.

FIG. 4 shows the dimensions of the respective conductive patterns in the state of FIG. 3(C). The dimensions in FIG. 4 are design values having the highest gain (directional characteristic) at a frequency of 2.4 GHz generally used for wireless LANs. The observed overall gain (directional characteristic) in this state was 9 dBi. In the state of FIG. 5(A), the first substrate 11 and the second substrate 12 combined together with the high directional characteristic are respectively received in the inner casing 15 and the outer casing 16 and are fixed by means of the screw 18. The first and the second substrates 11 and 12 are arranged to keep the positional relation of FIG. 4 and have the high directional characteristic.

Figure 5B:
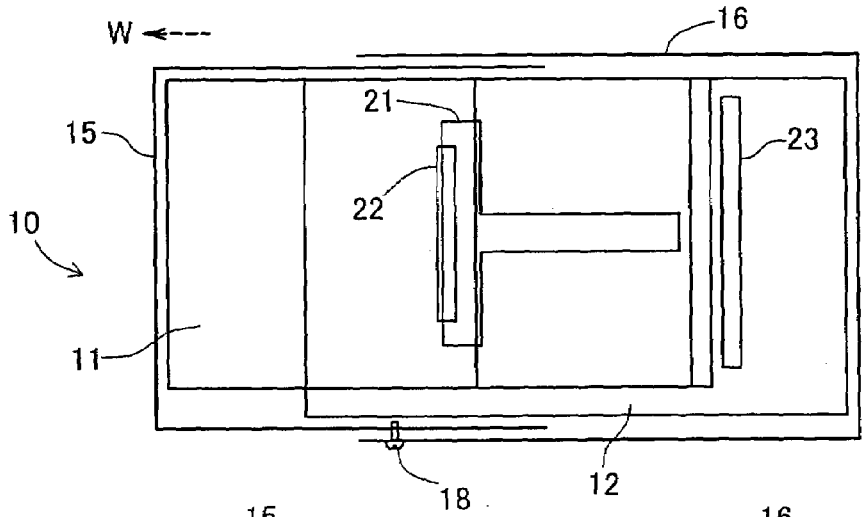

In the state of FIG. 5(A), the user loosens the screw 18 to make the inner casing 15 freely movable and pulls the inner casing 15 in the direction of an arrow W. The first substrate 11 held in the inner casing 15 is naturally moved together. The user refers to a marking MK printed on the outer surface of the inner casing 15 and tightens the screw 18 at the position of FIG. 5(B) to fasten the inner casing 15 to the outer casing 16. In the state of FIG. 5(B), the radiator formed as the conductive pattern 21 on the first substrate 11 mostly overlaps the wave director formed as the conductive pattern 22 on the second substrate 12. The observed overall gain in this state was 6.5 dBi.

Figure 5C:
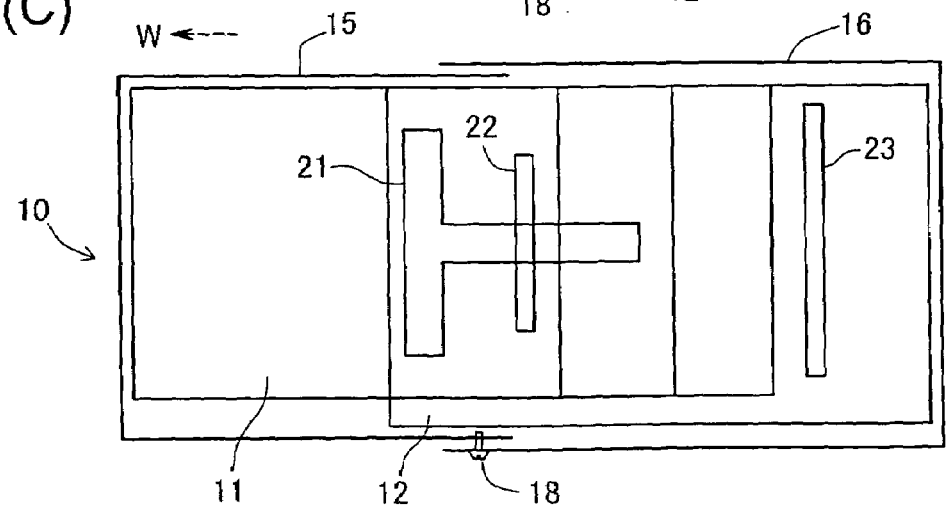

In the state of FIG. 5(B), the user again loosens the screw 18 and further pulls the inner casing 15 in the direction of the arrow W. The user refers to another marking MK printed on the outer surface of the inner casing 15 and tightens the screw 18 at the position of FIG. 5(C) to fasten the inner casing 15 to the outer casing 16. In the state of FIG. 5(C), the radiator formed as the conductive pattern 21 on the first substrate 11 is ahead of the wave director formed as the conductive pattern 22 on the second substrate 12. The observed overall gain was approximately 2 dBi. In this state, neither the wave director nor the reflector practically works, and the antenna device 10 functions as a non-directional dipole antenna.

As described above, the antenna device 10 of the first embodiment works as an external antenna of the access point 40. The antenna device 10 of the embodiment is readily switched over between the application as the Yagi-Uda antenna having the high directional characteristic and the application as the non-directional dipole antenna by simple movement of the inner casing 15 relative to the outer casing 16. The antenna device 10 may also work as an antenna having intermediate directional characteristic at the middle position. The access point 40 is located on the substantial center in a working area (for example, a room), and the antenna device 10 is arranged substantially upright. The antenna device 10 functions as the non-directional antenna at the position of FIG. 5(C) where the inner casing 15 is pulled to the furthermost position. A client computer located in the working area can thus establish wireless LAN communication with the antenna device 10. In this working state, the antenna device 10 has substantially no directional characteristic. The client computer may thus be located at any arbitrary position in the working area to establish good wireless communication with the antenna device 10.

When a client computer or another access point is distant from the access point 40, the inner casing 15 of the antenna device 10 is inserted into the outer casing 16 to the position of FIG. 5(A). The antenna device 10 has the highest possible directional characteristic at this position. The antenna device 10 faces to a communication object for adjustment of the angle of the antenna device 10. At this position, the antenna device 10 works as a Yagi-Uda antenna having the high directional characteristic and can thus establish communication with the remote client computer or another remote access point. The user readily finds the direction of the high directional characteristic according to the orientation of the antenna device 10. An arrow or circular mark representing the coverage of the antenna device 10 may preferably be printed on the surface of the outer casing 16 to help the user find the direction of the high directional characteristic.

The inner casing 15 and the outer casing 16 of the antenna device 10 may be located at the position of FIG. 5(B). The antenna device 10 has the intermediate degree of directional characteristic in this state. The antenna device 10 at this position is especially effective for the application of a wireless LAN that establishes wireless communication between the access point 40 located at the corner of a room and a client computer located in the room, while restricting the coverage to the inside of the room.

From the user's standpoint, the above description mainly regards the change of the directional characteristic of the antenna device 10 corresponding to a change in positional relation of the inner casing 15 to the outer casing 16. The positional relation of the inner casing 15 to the outer casing 16 is equivalent to the positional relation of the first substrate 11 to the second substrate 12, and eventually represents the positional relation of the conductive pattern 21 as the radiator to the conductive patterns 22 and 23 as the wave director and the reflector. The degree of directional characteristic corresponding to each positional relation is readily computable according to the design theory of the antenna. The positional relation to attain each desired level of directional characteristic is set based on the results of the computation and is marked on the outside of the casing. In the structure of the first embodiment, the first substrate 11 is moved relative to the second substrate 12. The design may be modified to make the second substrate movable to the first substrate. The conductive patterns formed on the second substrate do not receive power supply and accordingly do not require wiring for power supply. This advantageously attains the arrangement of readily moving the second substrate relative to the first substrate.

Figure 6:
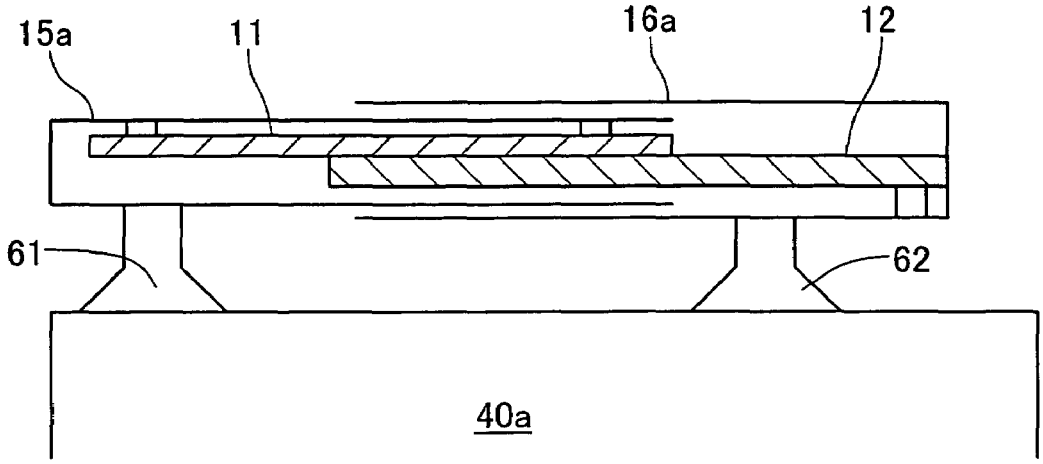
FIG. 6 shows the structure of a modified example of the first embodiment.

In the structure of the first embodiment, the antenna device 10 is attached to the access point 40 by means of the three-dimensional joint 50. The antenna device 10 may be fixed to an access point 40*a* by means of suckers 61 and 62 as shown in a modified structure of FIG. 6. The sucker 61 is located at one end of an inner casing 15*a*, while the sucker 62 is set on an outer casing 16*a*. The suckers 61 and 62 are sucked on and fastened to a top face of the housing of the access point 40*a*. This structure does not require any screw for fixing the inner casing 15*a* to the outer casing 16*a*.

Figure 7:
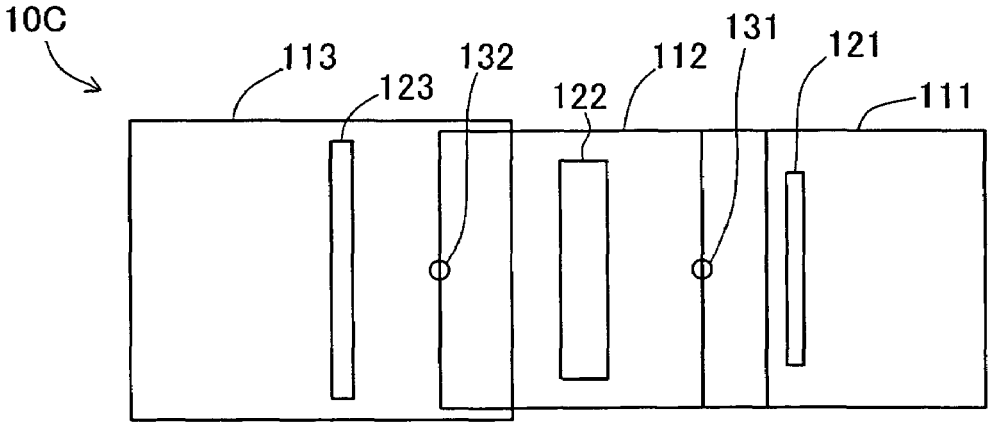
FIG. 7 schematically illustrates the structure of another antenna device in a second embodiment of the invention.
Figure 8:
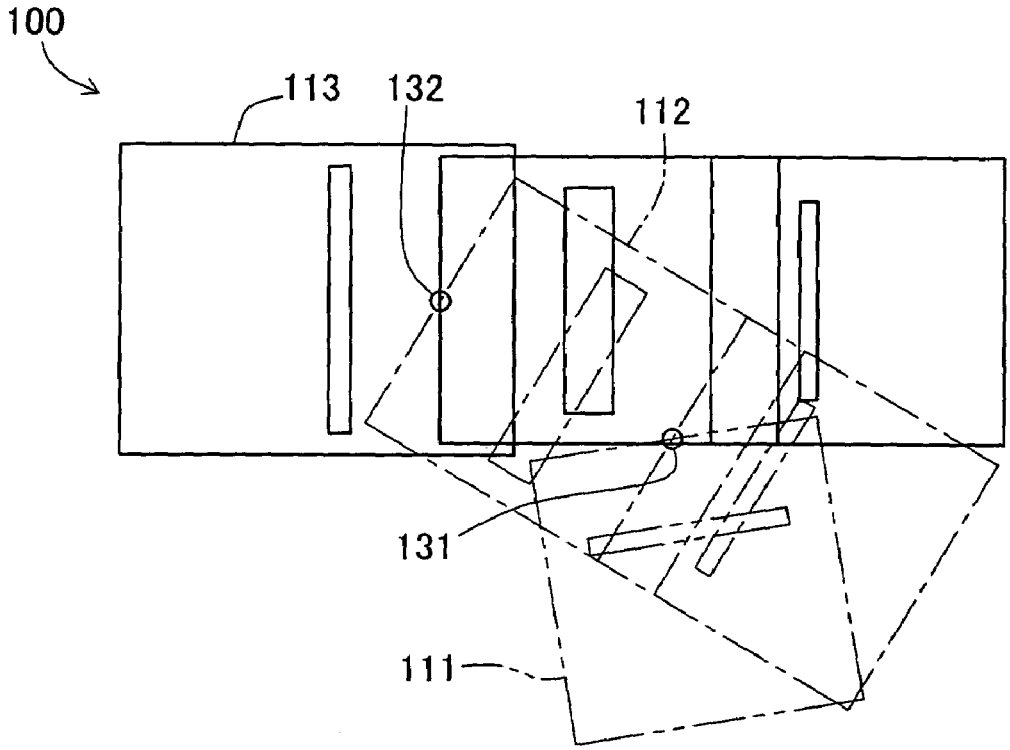
FIG. 8 shows an orientation of the antenna device of the second embodiment to lower its directional characteristic.

FIGS. 7 and 8 show the positional relation of first, second, and third substrates 111, 112, and 113 in an antenna device 100 in a second embodiment of the invention. As shown in FIG. 7, a conductive pattern 121 functioning as a wave director, a conductive pattern 122 functioning as a radiator, and a conductive pattern 123 functioning as a reflector are respectively formed on the first substrate 111, on the second substrate 112, and on the third substrate 113. For the simplicity of explanation, casings of the antenna device 100 and an access point are omitted from the illustration of FIGS. 7 and 8.

As shown in FIG. 8, the first substrate 111 is connected to the second substrate 112 in a rotatable manner about an end center 131, while the second substrate 112 is connected to the third substrate 113 in a rotatable manner about an end center 132. In the state of FIG. 7, the wave director, the radiator, and the reflector are arranged in parallel across preset intervals, and the antenna device 100 works as a Yagi-Uda antenna having the high directional characteristic. When the first substrate 111 and the second substrate 112 are rotated at predetermined rotational angles about the end centers 131 and 132 as shown in FIG. 8, the degree of directional characteristic is lowered corresponding to the rotational angle. In the orientation where the first substrate 111 and the third substrate 113 are respectively located at angles of 90 degrees with the second substrate 112, the conductive patterns 121 and 123 do not practically serve as the wave director and the reflector, while the conductive pattern 122 serves as the radiator. In the state of FIG. 8, the directional characteristic thus practically disappears, and the antenna device 100 works as a non-directional antenna.

In the structure of FIG. 8, the second substrate 112 and the first substrate 111 are rotated relative to the third substrate 113. It is, however, more desirable to attach a casing of the second substrate 112 to a top face of an access point and link a casing of the first substrate 111 and a casing of the third substrate 113 to the casing of the second substrate 112 in a rotatable manner. This arrangement ensures stationary connection of a power line to the conductive pattern 122 functioning as the radiator and thus attains the simplest structure as a whole. A casing of another substrate may alternatively be attached to the access point according to the requirements.

The structure of the second embodiment rotates the substrates to vary the degree of directional characteristic of the antenna device 100 in a significantly wide range and thus readily switches over its application among the function as the directional antenna, the function as the non-directional antenna, and the function as the antenna having the intermediate degree of directional characteristic, like the first embodiment. In the structure of the second embodiment, one wave director, one radiator, and one reflector are separately mounted on the first through the third substrates 111 through 113. Two or more wave directors may be mounted on one substrate for the enhanced degree of directional characteristic. Two or more wave directors may alternatively be mounted on multiple different substrates and may be folded in four or five.

Figure 9:
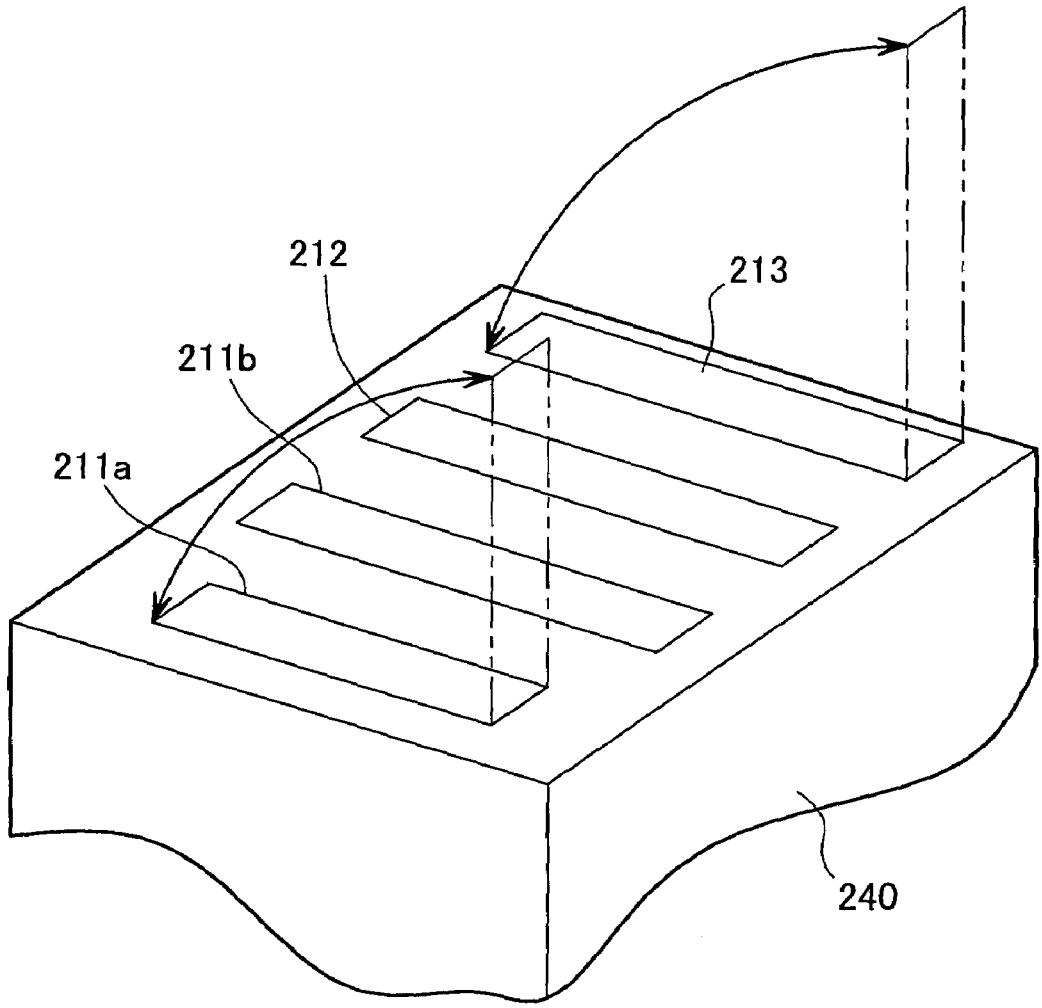
FIG. 9 schematically illustrates the structure of still another antenna device in a third embodiment of the invention.

FIG. 9 shows the structure of another antenna device 200 in a third embodiment of the invention. As illustrated, this antenna device 200 is integrally formed with a top face of an access point 240. The antenna device 200 includes a specified shape of metal plate (copper plate in this embodiment) 212, which functions as a radiator in the Yagi-Uda antenna, two metal plates 211*a* and 211*b* arranged on one side of the metal plate 212 in parallel with the metal plate 212, and another metal plate 213 arranged on the opposite side of the metal plate 212 in parallel with the metal plate 212. The metal plates 212, 211*a*, 211*b*, and 213 are all coated with a resin to prevent direct exposure of the metal surface. Among the four metal plates, the metal plates 211*a* and 213 arranged on both ends are bendable up to an upright position of 90 degrees about respective fixed ends as shown in FIG. 9. The structure of the embodiment does not adopt any additional hinge joints but bends the resin-coated metal plates by taking advantage of their inherent flexibility. Adjustment of the directional characteristic of the antenna is not required many times, but is generally performed only on the occasion of a change of the setting conditions. The inherent flexibility of the metal plates is thus sufficient for such adjustment, although additional hinge joints may be adopted.

In the state that all the metal plates 211*a*, 211*b*, 212, and 213 are parallel to the top face of the access point 240, the metal plates 211*a* and 211*b* work as wave directors and the metal plate 213 works as a reflector. The antenna device 200 as a whole functions as a Yagi-Uda antenna having the high directional characteristic with regard to 2.4 GHz radio frequency signals. In the state that only the metal plate 211*a* is bended at 90 degrees, the antenna device 200 has the intermediate degree of the directional characteristic. In the state that the metal plate 213 working as the reflector is additionally bended at 90 degrees, the antenna device 200 has practically no directional characteristic and functions as a non-directional antenna. In the structure of the third embodiment, the other metal plate 211*b* working as the wave director is not bendable. One possible modification additionally makes this metal plate 211*b* bendable for the subtle adjustment of the directional characteristic. The metal plates may be kept at a bending angle of less than 90 degrees for adjustment of the directional characteristic. The metal plates may otherwise be designed to be rotatable in a plane parallel to the top face of the access point 240, instead of the bendable design. Such rotation disables the functions of the wave director and the reflector. Another possible modification fixes the metal plates arranged on both ends and designs the metal plate 212 working as the radiator to be bendable at 90 degrees. Under the bending position of the metal plate 212, the antenna device 200 functions as a non-directional antenna.

As described above, the antenna device 200 of the third embodiment is capable of readily changing its function between the Yagi-Uda antenna having the high directional characteristic and the non-directional antenna, like the first and the second embodiments. The degree of the directional characteristic is easily adjustable by regulating the bending angles of the metal plates. Other advantages of the third embodiment include the simple general structure and the low-cost manufacturing.

Figure 10:
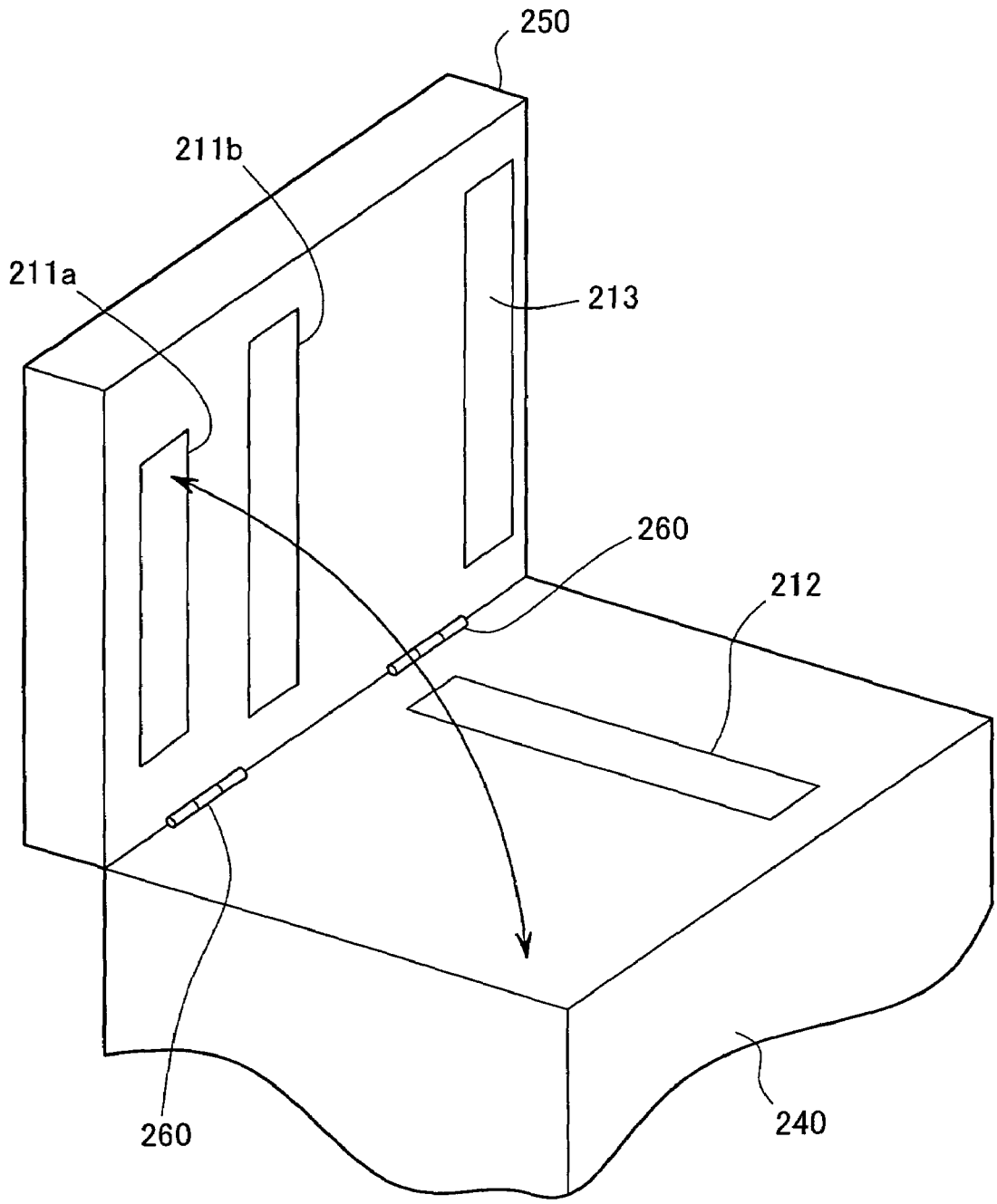
FIG. 10 shows the structure of a modified example of the third embodiment.

In the structure of the third embodiment, the metal plates are coated with the resin and are separately bendable by taking advantage of their flexibility. In one modified structure shown in FIG. 10, the metal plates 211*a* and 211*b* working as the wave directors and the metal plate 213 working as the reflector are formed in one integral thin member 250. The thin member 250 is fixed to the access point 240 by means of hinges 260 to be pivotally rotatable up to 90 degrees. This structure effectively prevents exposure of the metal plates. The specifications for adjustment and change of the directional characteristic may be printed on the outside of the thin member 250.

The embodiments discussed above are to be considered in all aspects as illustrative and not restrictive. There may be many modifications, changes, and alterations without departing from the scope or spirit of the main characteristics of the present invention. For example, the antenna device is directly linked to the access point in the above embodiments. The antenna device may be an external antenna externally attached to the access point. The number of the wave directors may be increased according to the requirements, while either one of the wave director and the reflector may be omitted when not necessary.

All changes within the meaning and range of equivalency of the claims are intended to be embraced therein. The scope and spirit of the present invention are indicated by the appended claims, rather than by the foregoing description.

The invention claimed is:

1. An antenna device suitable for use in an extremely high frequency wireless LAN, said antenna device comprising:

a wave director of a preset length, a reflector, and a radiator that are arranged to have a changeable positional relation wherein the wave director and the reflector are located in parallel across a predetermined distance on a first member, the radiator being located on a second member, which is different from the first member, and a moving mechanism that is arranged to move at least one of the wave director, the reflector, and the radiator to switch the positional relation between a first position where the wave director, the reflector, and the radiator are arranged in parallel with one another across preset intervals and have identical centers and a second position that is different from the first position, the first member and the second member being movable to attain the first position and the second position; and wherein said antenna device functions as a directional antenna at the first position and functions as a non-directional antenna at the second position.

2. An antenna device in accordance with claim 1, wherein the first member and the second member are movable between the first position and the second position by at least one of a sliding motion and a rotational motion.

3. An antenna device in accordance with claim 2, wherein the wave director has multiple conductors arranged in parallel.

4. An antenna device in accordance with claim 2, said antenna device being attached to an access point device for controlling the wireless LAN by means of a three-dimensionally movable joint.

5. An antenna device suitable for use in an extremely high frequency wireless LAN, said antenna device comprising:

a wave director of a preset length, a reflector, and a radiator that are arranged to have a changeable positional relation wherein the wave director, the reflector, and the radiator are located respectively on a first member, a second member, and a third member; and a moving mechanism that is arranged to move at least one of the wave director, the reflector, and the radiator to switch the positional relation between a first position where the wave director, the reflector, and the radiator are arranged in parallel with one another across preset intervals and have identical centers and a second position that is different from the first position; and wherein the first member, the second member, and the third member are movable between the first position and the second position by at least one of a sliding motion or a rotational motion and said antenna device functions as a directional antenna at the first position and functions as a non-directional antenna at the second position.

6. An antenna device in accordance with claim 5, wherein the wave director has multiple conductors arranged in parallel.

7. An antenna device in accordance with claim 5, said antenna device being attached to an access point device for controlling the wireless LAN by means of a three-dimensionally movable joint.

8. An antenna device in accordance with claim 1, wherein the wave director and the reflector are arranged in parallel with an axial direction of the radiator to attain the first position; and at least one of the wave director and the reflector is moved to a location crossing the axial direction of the radiator to attain the second position.

9. An antenna device in accordance with claim 8, wherein the wave director has multiple conductors arranged in parallel.

10. An antenna device in accordance with claim 8, said antenna device being attached to an access point device for controlling the wireless LAN by means of a three-dimensionally movable joint.

11. An antenna device in accordance with claim 1, wherein the wave director has multiple conductors ranged in parallel.

12. An antenna device in accordance with claim 11, said antenna device being attached to an access point device for controlling the wireless LAN by means of a three-dimensionally movable joint.

13. An antenna device in accordance with claim 1, said antenna device being attached to an access point device for controlling the wireless LAN by means of a three-dimensionally movable joint.

14. An antenna device in accordance with claim 13, wherein a signal line passes through inside of the joint to establish electrical connection with the access point device.

15. An antenna device in accordance with claim 1, said antenna device having a sucker that is fixable to a housing of the access point device.

16. An antenna device in accordance with claim 1, wherein the wave director has multiple conductors arranged in parallel.

17. An antenna device in accordance with claim 1, said antenna device being attached to an access point device for controlling the wireless LAN by means of a three-dimensionally movable joint.

18. An antenna device in suitable for use in an extremely high frequency wireless LAN, said antenna device comprising:

a wave director of a preset length, a reflector, and a radiator that are arranged to have a changeable positional relation a moving mechanism that is arranged to move at least one of the wave director, the reflector, and the radiator to switch the positional relation between a first Position where the wave director, the reflector, and the radiator are arranged in parallel with one another across preset intervals and have identical centers and a second position that is different from the first position, wherein said moving mechanism moves at least one of the wave director, the reflector, and the radiator to attain a third position, which is an intermediate position between the first position and the second position; and wherein said antenna device functions as a directional antenna at the first position and functions as a non-directional antenna at the second position and said antenna device has an intermediate application between the application as the directional antenna and the application as the non-directional antenna at the third position.

* * * * *